US010092808B2

(12) United States Patent
Clark et al.

(10) Patent No.: US 10,092,808 B2
(45) Date of Patent: Oct. 9, 2018

(54) GOLF TEACHING AID

(76) Inventors: Dana A. Clark, Edgewater, MD (US); Winifred Nabb Sewell, Annapolis, MD (US)

( * ) Notice: Subject to any disclaimer, the term of this patent is extended or adjusted under 35 U.S.C. 154(b) by 118 days.

(21) Appl. No.: 13/315,211

(22) Filed: Dec. 8, 2011

(65) Prior Publication Data

US 2012/0184388 A1 Jul. 19, 2012

Related U.S. Application Data

(60) Provisional application No. 61/432,778, filed on Jan. 14, 2011.

(51) Int. Cl.
*A63B 69/36* (2006.01)

(52) U.S. Cl.
CPC ..... *A63B 69/3608* (2013.01); *A63B 2209/00* (2013.01); *A63B 2209/10* (2013.01)

(58) Field of Classification Search
USPC ..... 473/207, 208, 212–219, 266, 275, 276, 473/409
See application file for complete search history.

(56) References Cited

U.S. PATENT DOCUMENTS 3,148,389 A * 9/1964 Lustig ..... 5/645
4,743,028 A * 5/1988 Harrison ..... 473/212
5,282,777 A * 2/1994 Myers ..... 482/122
5,522,757 A * 6/1996 Ostrowski ..... 446/220
5,652,983 A * 8/1997 Kraemer ..... 5/639
5,735,776 A * 4/1998 Swezey et al. ..... 482/91
6,176,790 B1 * 1/2001 Latella ..... 473/219
6,237,599 B1 * 5/2001 Maulding ..... 128/845
6,438,778 B1 * 8/2002 Johnson ..... 5/636
6,891,078 B1 * 5/2005 Dillard ..... 602/53
7,204,767 B2 * 4/2007 Roberts et al. ..... 473/276
7,441,292 B2 * 10/2008 Williams et al. ..... 5/636
7,584,516 B1 * 9/2009 Sneed ..... 5/650
7,758,437 B1 * 7/2010 Stewart ..... 473/212
2005/0049068 A1 * 3/2005 Chang ..... 473/276
2008/0119299 A1 * 5/2008 Merrill ..... 473/212
2008/0153615 A1 * 6/2008 Baird et al. ..... 473/207

* cited by examiner

*Primary Examiner* — Nini Legesse

(74) *Attorney, Agent, or Firm* — Barbara J. Luther; Luther Law Firm

(57) ABSTRACT

A golf aid has a compressible center shaped to fit comfortably between a golfer's upper arm and torso; and a slippery covering over the compressible center, such that the golfer must compress the golf aid in the armpit to prevent slippage of the golf aid. This enables the golfer to develop a consistent set-up and address posture with the appropriate tension in the correct muscles. This golf aid has been found to be helpful in correcting the golfer's swing and in improving the short game and putting.

9 Claims, 2 Drawing Sheets

GOLF TEACHING AID

RELATED APPLICATION

This patent application claims the benefit of U.S. Provisional patent application 61/432,778, filed Jan. 14, 2011.

BACKGROUND

A common problem among golfers is the slice in which the golf ball is improperly hit and goes off at an unwanted angle. Slices and hooks are the result of improper swing path, club face position and shaft angle at impact. Tension in the neck and shoulders during the take-away will cause the golfer to bring back the club out of sequence and off swing plane. Improper club position at the top of the backswing forces the golfer to bring the club down and through impact in an "outside to inside" or "inside to outside' path resulting in either a slice or a hook.

One of the most common swing flaws of this genre is aptly named the "flying elbow." The flying elbow resembles a baseball swing movement, in that the elbow is pulled up and away from the torso and, at the top of the backswing, is set parallel to the ground rather than perpendicular. The lead shoulder dips toward the ground forcing the golfer's hips and torso into an incorrect, forward leaning position. This in turn causes the golfer to push the club away from the body and out of the proper swing path during the downswing, resulting in an incorrect club face position and shaft angle at impact.

Numerous ways to control the slice have been proposed (e.g., U.S. Pat. Nos. 7,204,767; 4,940,237; 4,058,852; 4,743,028; 4,960,280; 4,892,317; 5,295,690; and 4,691,924). However, none of those are easy to use by an individual golfer. Moreover, they look strange, and many golfers would be embarrassed to use them on the golf practice range. Golfers may give up on them before their slice or hook is corrected, or they may not get them out of storage when the problem recurs, as it frequently does.

SUMMARY OF INVENTION

In one embodiment, a golf aid has a compressible center shaped to fit comfortably between a golfer's upper arm and torso; and a slippery covering over the compressible center, whereby the golfer compresses the golf aid in the armpit to prevent slippage of the golf aid. The golf aid of claim 1 optionally has a cover of nylon 100. The golf aid center can be rayon. The golf aid center can be a blended fiberfill of 50% rayon from bamboo and 50% polyester. Optionally the golf aid has a loop. Examples of loop materials include cloth and metal. A carabineer loop can be used In another embodiment there is disclosed a method of reducing the golf slice or hook. This method includes the steps of providing a compressible golf aid with a slippery covering; placing the golf aid between a golfer's dominant upper arm and torso; and compressing the golf aid to maintain it in place during the golf swing; thereby preventing the dominant arm from having flying elbow, or an improper arm position that causes the slice or hook.

In yet another embodiment, there is disclosed a method of improving a golfer's short game. This method includes the steps of providing two compressible golf aids, each with a slippery covering; placing the golf aids between the upper arm and torso on both sides; and compressing the golf aids to maintain them in place during the short swing; thereby enabling the golfer to move correctly through impact with the ball.

In another embodiment, there is disclosed a method of improving a golfer's putting game. This method includes the steps of providing two compressible golf aids, each with a slippery covering; placing the golf aids between the upper arm and torso on both sides; and compressing the golf aids to maintain them in place during the putting swing; thereby enabling the golfer to move correctly through putting the ball.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE INVENTION

We created and designed our invention to assist golfers of all skill levels, in using the correct muscles necessary to implement a proper golf swing. Improper muscle tension is one of the leading causes of the "slice" and "hook" swing movement common among amateur golfers. Often golfers arrive at the golf course and driving range carrying the muscle tension of busy days and traffic snarls. To regain the proper swing, they require an easy-to-use product that easily fits in or attaches to the golf bag. Prior art devices can be complicated to use, make the golfer look silly, and may not even get to the core of the problem: improper muscle tension.

Our invention is uniquely designed to assist the golfer in diverting muscle tension away from the neck and shoulders while directing the proper tension toward the armpit, elbows and wrists. Neck and shoulder tension inhibits a smooth, fluid "take-away" and prohibits a proper upper body turn. Diverting muscle tension away from the neck and shoulders assists the golfer in keeping the club on the proper "swing plane" and in using the core muscle group to generate power rather than "swinging with all arms."

Figure 1:
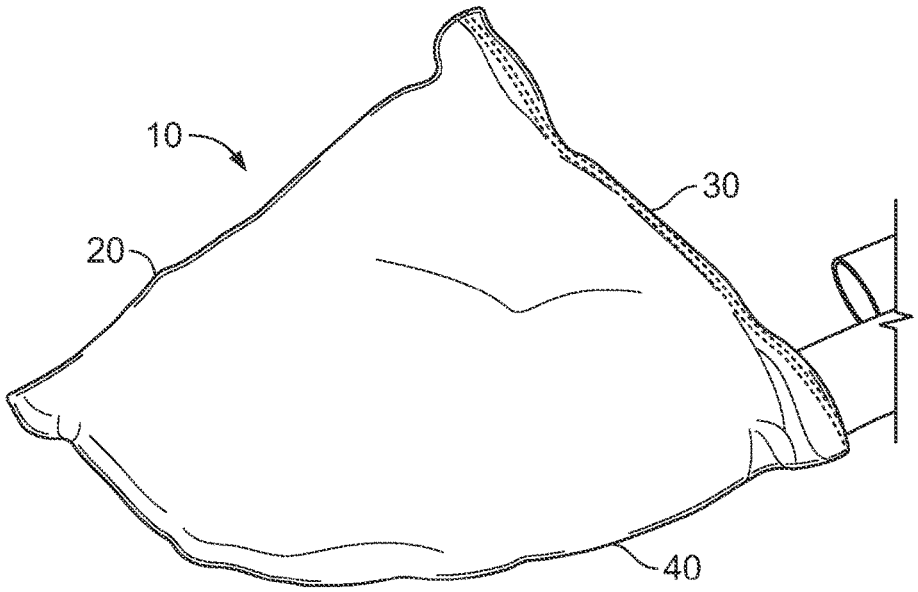
FIG. 1 is an overview photo of one embodiment of the golf aid.

This golf aid is designed to fit in the golfer's armpit. The device can be used under each arm, but most importantly under the golfer's dominant arm (i.e., under the right arm for a right-handed golfer). We designed our prototype from a clothing shoulder pad, only much thicker. FIG. 1 shows the golf aid 11 that has the shape of two right-angled, straight side 20, 30 and a concave curve 40. However, it should be understood that the golf aid can be any comfortable shape.

Importantly the outer material is intentionally slippery. Suitable materials include 100% nylon or polyester mix or alternately anti-microbial fabric. Knit materials are preferred, as they conform to the compressed shape, too. Preferably, the outer material is slippery. This slippery material contributes to the instability of the golf aid. The golfer must continuous apply the proper muscle tension to keep the device in place during the course of the swing.

The inner materials are such that the golf aid nominally conforms to the armpit without permanently molding to shape. Almost any soft, compressible material can be used. So far we have tried polyethylene foam, polyethylene pellets, polyethylene fill, sand/gravel and buckwheat fill with varying degrees of success. One preferred inner material consists of a blended fiberfill of 50% rayon from bamboo and 50% polyester.

Figure 2:
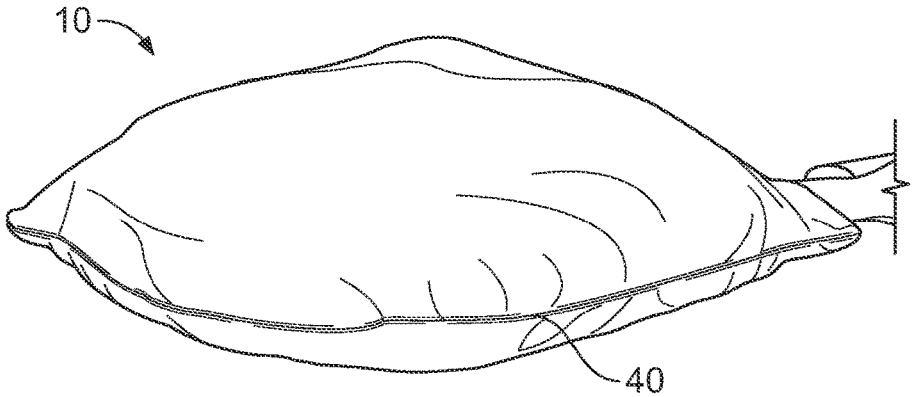
FIG. 2 is a side view of the same embodiment of the golf aid.

The thickness of the inner material is chosen to enable the golfer to compress the upper arm against the side chest wall. The thickness of the golf aid needs to be at least 1 cm and no more than about 12 cm. Preferably the golf aid is about 4 cm to about 8 cm thick. More preferably the golf aid is about 5 cm thick (FIG. 2). The thickness can vary with the stiffness of the inner material, with less thickness needed with stiffer materials. Preferably, the golf aid compresses to a thickness of about 1-3 cm when in use.

Figure 3:
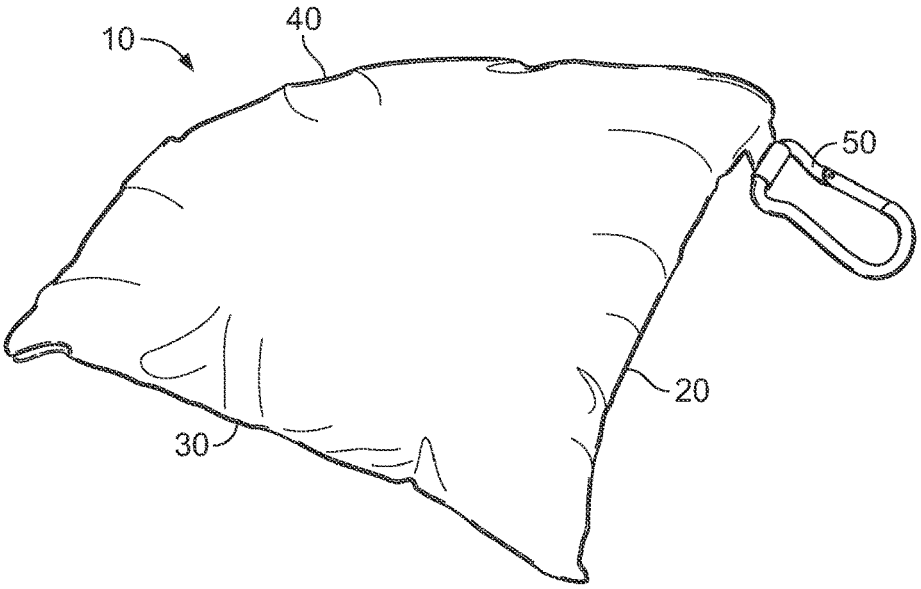
FIG. 3 is an overview photo of another embodiment of the golf aid with an optional clip that conveniently attaches to a golf bag.

The outer dimensions also can vary from a minimum of 1 cm in one direction to at most 30 cm in another direction. Larger dimensions are likely to become too awkward to place properly and difficult to maintain between the upper arm and the side chest wall. An exemplary golf aid has straight sides 20, 30 of about 12 by 16 cm. Another exemplary golf aid has a thickness of 5 cm and side dimensions 20,30 of 15 cm and 17.5 cm, respectively, and a curved edge 40 of 22.5 cm (FIG. 3).

While the golf aid can be provided as described above, it will be more functional with at least one tab 50 that can be used to attach the golf aid to the side of a golf bag. One exemplary attachment is the use of VELCRO® strips that can be threaded through a loop on the golf bag and pressed together so that the hooks and eyes hold the golf aid in place for quick use and storage. Another exemplary attachment is a simple cloth loop, such as grosgrain, which is a woven silk or rayon fabric with narrow horizontal ribs. A preferred loop is a carabineer hook, which is an oblong metal ring with a spring clip which is depressed to clip to another loop on the golf bag. For example, the strips and loops can be attached to the golf aid by sewing into a side seam (e.g., 20) or can be attached to the outer material by any of the known means for attachment, including but not limited to sewing and gluing.

Figure 4:
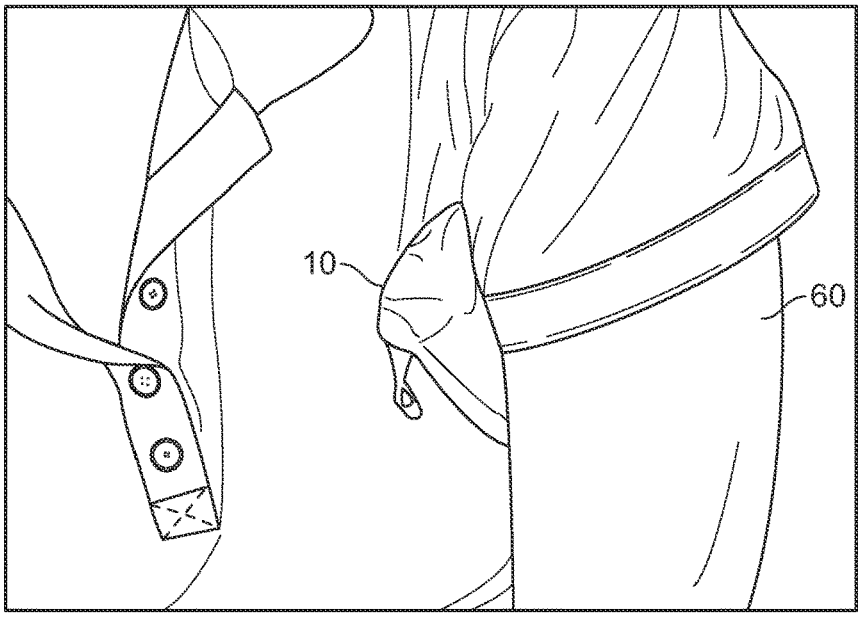
FIG. 4 shows the embodiment of FIG. 3 tucked in the underarm of a golfer.

Any training device is only successful if it is used regularly. We believe a major problem with prior golf training devices is that they look strange and are hard to use. They have straps and buckles and blatantly announce that the golfer needs training. We offer no such straps or buckles or manner of attachment to the golfer. Our device is very easy to use and simply slips under the arm 60 (FIG. 4), so it is not as high profile. Therefore, golfers will be less embarrassed to use it on a routine basis and will achieve more benefit therefrom.

With proper and repeated use, I have observed golfers develop a consistent set-up and address posture which incorporates the appropriate muscle tension. Preferably, the golfer uses the golf aid during range practice to reinforce the necessary muscle focus. After several successful swings, the golfer removes the golf aid and swings using the same muscle tension. After repeated use, a "phantom effect" will occur, indicating the golfer has learned to swing as if the golf aid were still in place. The new "muscle memory" will promote a proper takeaway move. This will help the golfer swing the club on the proper swing plane, square the club face at impact and deliver the club through impact with the shaft angle in the proper position, thus preventing the slice and hook swing path.

While our golf aid appears simple, it is annoying in its instability. Therefore, the golfer must make a concerted effort to keep the golf aid in place and focus on turning the upper body along with the arms, rather than pulling the club back and swinging using only the arms. After repeated use, it becomes easier to keep the golf aid in place because the golfer is automatically focusing the tension in the correct places to induce the phantom effect.

Surprisingly the inventive golf aid has been found to be not only effective for slice and hook eradication when used for full swings, but also remarkably efficient for improving short game swing techniques including putting. A common problem in the short game is that the wrists become overly active and the golfer flips the club with the hands rather than move the body through the shot keeping the torso, elbows and wrists in the proper position in order to square the club face at impact. Moving the muscle tension away from the wrists toward the elbows and torso allows the golfer to move correctly through impact with the ball and greatly enhances accuracy in pitching and chipping. In this use, the golfer benefits when the inventive golf aid is placed under both armpits during short game practice drills.

The advantages of this device over other aids are in its versatility, simplicity and ease of transport. The device(s) can be used for full swings, pitching and chipping swings, as well as putting strokes. The design is straightforward and simple to make. It can be clipped onto the golf bag or belt loop, or the golf aid can be stuffed in a pocket if the golfer is only carrying a few clubs to the practice range.

Moreover, the simplicity of the device lends it to ease of marketing. Different colors and patterns can be used on the golf aid to advertise sponsors and others. It is ideal for inclusion in a gift bag at a charity golf tournament. Better yet, the product has an extended shelf life as an advertising tool, much longer than a logo golf ball.

EXAMPLES

One inventor is a golf teaching pro and thus is a trained observer of golfers and their problems and improvements. These are her reports of experimental sessions with golfers, including beginners and experienced golfers.

A right-handed nurse complained of right shoulder pain after practicing at the practice range. I explained that she was using too much tension in the shoulder area during takeaway, rather than keeping the tension in the elbow/torso area. The nurse tucked the golf aid under her right arm and within the space of a single lesson, her swing improved dramatically. She experienced no more pain.

A female softball player with a baseball-type swing also complained of pain in her right shoulder. After trying the golf aid, her swing gradually improved and her pain decreased.

Beginning golf students, who used the golf aid, more quickly learned the proper take-away movements than those beginning students who did not use it. Those students who did not use the golf aid took a noticeably longer period of time to achieve that end. The golf aid quickly trained the student from the start, thus saving them time, effort and money for instruction. This is an unexpected and distinct advantage to using the golf aid in early training on how to swing a club.

More experienced students, who have developed bad habits or swing flaws, as mentioned throughout, needed to re-learn the golf swing and re-focus the muscle tension. The golf aid significantly cut down the re-learning/re-training time (e.g., see "nurse" example above).

One inventor's own experience with using the golf aid is noteworthy. I have long struggled with my short game. I have trouble holding my wrists steady and flip the club with my hands rather than moving my body through the shot while keeping the torso, elbows and wrists in the proper position in order to square the club face at impact. I decided to use a golf aid under each arm in order to create a proper chipping and pitching move. After practicing chips and pitches with the golf aid for an hour, I realized that I was better able to move through impact and release the club properly, without flipping my hands. I then played a round of golf and was impressed by the improvement in my short game swing. Not only was my short game improved, but I found I had a more fluid putting stroke!

While working with an older gentleman who had lost power in his swing and wanted more distance and accuracy, I introduced him to our golf training aid. He struggled with it for about six or seven swings and then was able to successfully complete a swing with the device in place. After several successful swings, he gained confidence in the movement and properly located pressure points (less in shoulders, more toward rib cage and elbows) and was able to make contact with the ball. Within approximately 10 minutes, he was able to square the club face at impact and properly move to the finish. At the end of the half hour lesson, he was setting up properly, squaring the club face at impact which eliminated the weak ball strike (fade/slice) and was moving his body to the finish! He was delighted with the results: more distance, straighter ball flight and body balance throughout the swing. His comment to me was that he wished that someone had shown him this concept when he started playing golf (over 20 years ago) and that he never knew you didn't need to swing using all arms!

Another of my students was a man in his twenties. He had been a baseball player in high school and college. This person had the typical flying elbow issue, but made athletic corrections during his downswing which were successful when he could square the club face, but more often were wild slices at terrific distances. This person spent more time in the woods on the right side of the golf course looking for balls than he did hitting shots from the fairway. Because he hit the ball so far, he often would hit an iron off the tee rather than use his driver because he was so erratic and in trouble off the tee. He came to me to learn how to hit his driver and keep it in play. We worked on the flying elbow issue by using the golf training aid. He quickly learned to properly move during the take-away by keeping the right elbow down and next to the body rather than up and too far away from his body core. It took some time to re-work his take-away move, but he was able to feel the correct way to move by using the training aid. When he moved the club back in the baseball/flying elbow position, the training aid would fall out. When he properly moved the club back in the takeaway, the training aid stayed in place.

I loaned this person the training aid for a week in between lessons. He went to the driving range three times and used the training aid. When he came back the following week for his lesson, there was a remarkable improvement in his set up, take-away and ball striking. The results after one week were significant. He hit his driver with a consistent "power fade" which enabled him to play the course using his driver and keeping the ball in play, not in the rough. Periodically, he would stop in to see me and borrow my training aid for a tune-up. He said that it reinforced the proper movement techniques that allowed him to keep the ball in play and enabled him to use the driver, woods and long irons with confidence. His scores and handicap decreased by 12 strokes over the course of the summer.

To those skilled in the art, a variety of alterations to the golf aid can be deduced. The golf aid can be made in any number of geometric configurations, such as circles, logos, squares, rectangles, etc. The golf aid can be filled with various types of compressible materials that return to their shape after compression between the arm and side chest wall. Depending on the flexibility of the stuffing, the thickness of the golf aid can be two inches thick for a soft liner or one inch thick for less compressible material.

While the invention has been shown in several embodiments, it should be apparent that it is not limited to those embodiments but is susceptible to various changes without departing from the scope of the invention.

The invention claimed is:

1. A golf aid comprising a) a compressible center shaped to fit comfortably between a golfer's upper arm and torso;

b) a slippery fabric material covering over the compressible center; and c) the golf aid having a thickness of about 4-8 cm and compressing to about 1-3 cm, whereby the golfer must compress the golf aid in the armpit to prevent slippage of the golf aid.

2. The golf aid of claim 1 wherein the fabric material is 100% nylon.

3. The golf aid of claim 1 wherein the center comprises rayon.

4. The golf aid of claim 3 wherein the center comprises a blended fiberfill of 50% rayon from bamboo and 50% polyester.

5. The golf aid of claim 1 further comprising a loop attached thereto.

6. The golf aid loop of claim 5 comprising a cloth or metal loop.

7. The golf loop of claim 6 comprising a carabineer loop.

8. A method of improving a golfer's short game, the method comprising a) providing two compressible golf aids, each with a slippery fabric material covering each having a thickness of about 4-8 cm;

b) placing the golf aids between the upper arm and torso on both sides; and c) compressing the golf aids to about 1-3 cm to maintain them in place during the short swing; thereby enabling the golfer to move correctly through impact with the ball.

9. A method of improving a golfer's putting game, the method comprising a) providing two compressible golf aids, each with a slippery fabric material covering each having a thickness of about 4-8 cm;

b) placing the golf aids between the upper arm and torso on both sides; and c) compressing the golf aids to about 1-3 cm to maintain them in place during the putting swing; thereby enabling the golfer to move correctly through putting the ball.

* * * * *